US009718657B2

(12) United States Patent
Mohr

(10) Patent No.: US 9,718,657 B2
(45) Date of Patent: Aug. 1, 2017

(54) SCISSOR LIFT TABLE AND METHOD FOR CHANGING A FIXED BEARING OF A SCISSOR LIFT TABLE

(71) Applicant: Christoph Mohr, Bielefeld (DE)

(72) Inventor: Christoph Mohr, Bielefeld (DE)

( * ) Notice: Subject to any disclaimer, the term of this patent is extended or adjusted under 35 U.S.C. 154(b) by 0 days.

(21) Appl. No.: 14/956,463

(22) Filed: Dec. 2, 2015

(65) Prior Publication Data

US 2016/0159628 A1 Jun. 9, 2016

(30) Foreign Application Priority Data

Dec. 3, 2014 (DE) ..... 10 2014 017 844

(51) Int. Cl.
*B66F 7/06* (2006.01)

(52) U.S. Cl.
CPC ..... *B66F 7/065* (2013.01); *B66F 7/0633* (2013.01); *B66F 7/0658* (2013.01)

(58) Field of Classification Search
CPC ..... B66F 7/06; B66F 7/065; B66F 7/0658; B66F 7/0633

(Continued)

(56) References Cited

U.S. PATENT DOCUMENTS 3,891,108 A * 6/1975 Traficant ..... B60P 1/02 254/122
5,105,915 A * 4/1992 Gary ..... A61G 3/063 14/71.3

(Continued)

FOREIGN PATENT DOCUMENTS

DE 29909442 U1 10/2000
DE 202006012777 U1 12/2007

(Continued)

OTHER PUBLICATIONS

Deutsches Patent—Und Markenmat (German Patent and Trademark Office), Office Action (in a related application), Nov. 23, 2016.

*Primary Examiner* — Joseph J Hail
*Assistant Examiner* — Tyrone V Hall, Jr.
(74) *Attorney, Agent, or Firm* — Laurence P. Colton; Smith Tempel Blaha LLC

(57) ABSTRACT

A scissor lift table (1) has a first base element (2) and a second base element (3) and a scissor (4). The scissor (4) has a first scissor part (6) and a second scissor part (7), wherein the first scissor part (6) and the second scissor part (7) are pivotable relative to one another about a scissor axis (5). The first base element (2) and the second base element (3) are connected by the scissor (4) such that a pivoting of the scissor parts (6, 7) relative to one another about the scissor axis (5) causes a change in the distance between the first base element (2) and the second base element (3), wherein the first scissor part (6) is pivotably borne on the first base element (2) using a fixed bearing (10) and the second scissor part (7) is displaceably and pivotably borne on the first base element (2) using a floating bearing (11). The scissor lift table (1) is designed such the first scissor part (6) may be pivotably fixed relative to the first base element (2) about a temporary pivot axis (12) and a mechanical connection (14) between fixed bearing (10) and first base element (2) may be disconnected and the position of the pivot axis is selected such that when the first scissor part (6) is fixed and the mechanical connection (14) is disconnected, reducing the distance between the first base element (2) and second base element (3) causes an increase in the distance between the first base element (2) and the fixed bearing (10).

12 Claims, 4 Drawing Sheets

(58) Field of Classification Search
USPC ..... 254/122, 124
See application file for complete search history.

(56) References Cited

U.S. PATENT DOCUMENTS

| | | | | |
|---|---|---|---|---|
| 5,636,711 | A * | 6/1997 | Nussbaum | B66F 7/0666 182/141 |
| 6,182,796 | B1 * | 2/2001 | Perlstein | B66F 7/065 187/208 |
| 7,055,802 | B1 * | 6/2006 | Jones | B62B 1/002 254/122 |
| 2003/0189194 | A1 * | 10/2003 | Latvys | B66F 7/08 254/9 C |
| 2009/0278098 | A1 * | 11/2009 | Bacon | B66F 7/0625 254/1 |
| 2011/0240409 | A1 * | 10/2011 | Bacon | B66F 7/065 187/269 |

FOREIGN PATENT DOCUMENTS

| | | | |
|---|---|---|---|
| DE | 102013006129 | | 4/2013 |
| WO | 2014166634 | A1 | 10/2014 |

* cited by examiner

SCISSOR LIFT TABLE AND METHOD FOR CHANGING A FIXED BEARING OF A SCISSOR LIFT TABLE

STATEMENT OF RELATED APPLICATIONS

This patent application claims the benefit of and priority on German Patent Application No. 10 2014 017 844.7 having a filing date of 3 Dec. 2014

BACKGROUND OF THE INVENTION

Technical Field

The invention relates to a scissor lift table, a scissor lift table system, and a method for changing a fixed bearing of a scissor lift table.

Prior Art

Scissor lift tables of the type in question have a first base element and a second base element. These base elements may be frames or platforms, wherein normally one base element is a foundation for the lift table, while the other base element is intended for supporting the load to be lifted by the lift table.

The two base elements are connected to one another by a scissor. The scissor has two scissor parts that are pivotable relative to one another about a scissor axis. The first scissor part is pivotably borne on the first base element using a fixed bearing, while the second scissor part is displaceably and pivotably borne on the first base element using a floating bearing. If the two scissor parts are now pivoted relative to one another about the scissor axis, this causes a change in the distance between the first base element and the second base element.

In lift tables of the type in question, all of the forces that are introduced into the upper base element by the load to be lifted by the lift table must necessarily be supported by the bearings of the base element. This subjects the bearings of the lift table, especially the fixed bearing, to noticeable wear. Therefore, for maintaining such lift tables it is necessary to change the bearings of the lift table regularly.

For instance, DE 10 2013 006 129 illustrates a lift table of the type in question in which changing the floating bearing is made easier using a special method and a special embodiment of the lift table. But even with such a lift table, there is still the problem of changing the fixed bearings. Since the fixed bearings permanently bear the load of at least one base element and possibly the scissor of the lift table, changing a fixed bearing is a complex procedure due to the associated disassembly of the lift table and the need for lifting heavy lift table parts on and off.

BRIEF SUMMARY OF THE INVENTION

The underlying object of the invention is therefore to provide a lift table, a lift table system, and a method for changing the fixed bearing of a lift table that simplify changing the fixed bearing of a lift table compared to the prior art.

The object is attained using a lift table, a lift table system, and a method having the features of the independent claims. The features of the dependent claims relate to advantageous embodiments.

In accordance with the invention, it is provided that the first scissor part is fixed relative to the first base element about a temporary pivot axis. Likewise, a mechanical connection between fixed bearing and first base element is disconnected. If the distance between the first base element and second base element is reduced, which may in particular occur by lowering the lift table, the first scissor part does not pivot relative to the first base element about the fixed bearing as usual, but rather about the temporary pivot axis. The consequence of this is that the fixed bearing moves relative to the first base element. The fixed bearing is preferably moved away from the first base element. This unloads the fixed bearing, and it also improves the accessibility of the latter, which simplifies the exchanging process. The further the fixed bearing is moved from the first base element, the lower the probability that elements of the first base element will prevent unimpeded access to the fixed bearing with appropriate tools for exchanging the fixed bearing.

The first base element is advantageously arranged below the second base element, i.e., the first base element is the element for which the changing of the fixed bearing is made more difficult by the weight of the scissor itself.

Analogously, the second scissor part is preferably pivotably borne on the second base element using another fixed bearing and, for changing this other fixed bearing, the second scissor part may analogously be pivotably fixed relative to the second base part about another temporary pivot axis.

If another mechanical connection between the other fixed bearing and the second base element is disconnected, the other fixed bearing may also be changed analogous to the fixed bearing that is allocated to the first base element. In accordance with one particularly preferred embodiment, all of the fixed bearings that connect the scissor with one of the base elements of the scissor lift table may thus be exchanged in a connection-like manner.

The temporary pivot axis is preferably arranged between the fixed bearing to be changed and the scissor axis. The arrangement of the temporary pivot axis between the fixed bearing and the pivot axis shall not be construed to mean that the temporary pivot axis must lie precisely on a straight line that connects the fixed bearing and the pivot axis. On the contrary, there is already an arrangement of the temporary pivot axis between the fixed bearing and the pivot axis and the scissor axis when the temporary pivot axis is disposed in the spatial area between the scissor bearing and the floating bearing. The temporary pivot axis is preferably arranged in the area of the first scissor part. This permits a simple design of the temporary axis, for instance, in that the latter is arranged in a bore in the first scissor part.

The temporary pivot axis is advantageously provided using a fixing device. The fixing device is especially means that may be connected with the lift table for providing a temporary pivot axis and may be removed again. The scissor table system formed from the lift table and the fixing device thus makes possible the simple exchange of the fixed bearing by means of the fixing device.

BRIEF DESCRIPTION OF THE DRAWINGS

The invention shall be described in greater detail in the following using FIGS. 1 through 5.

DETAILED DESCRIPTION OF PREFERRED EMBODIMENTS

Figure 1:
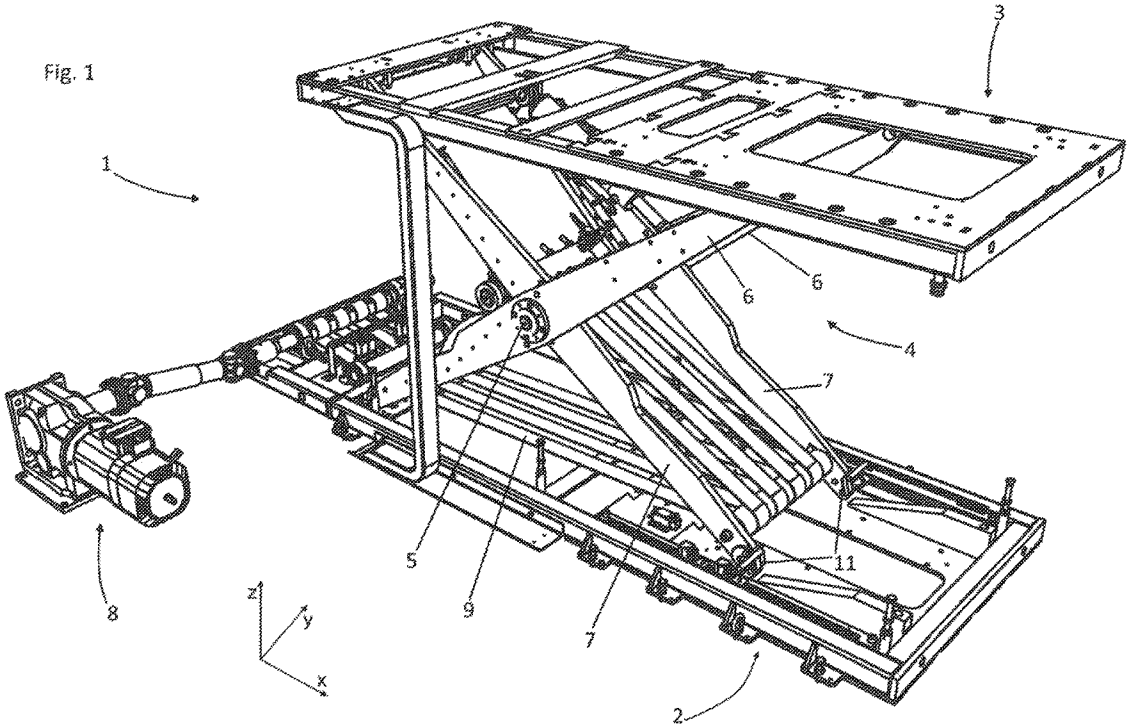
FIG. 1 is a perspective elevation of an exemplary inventive lift table.
Figure 2:
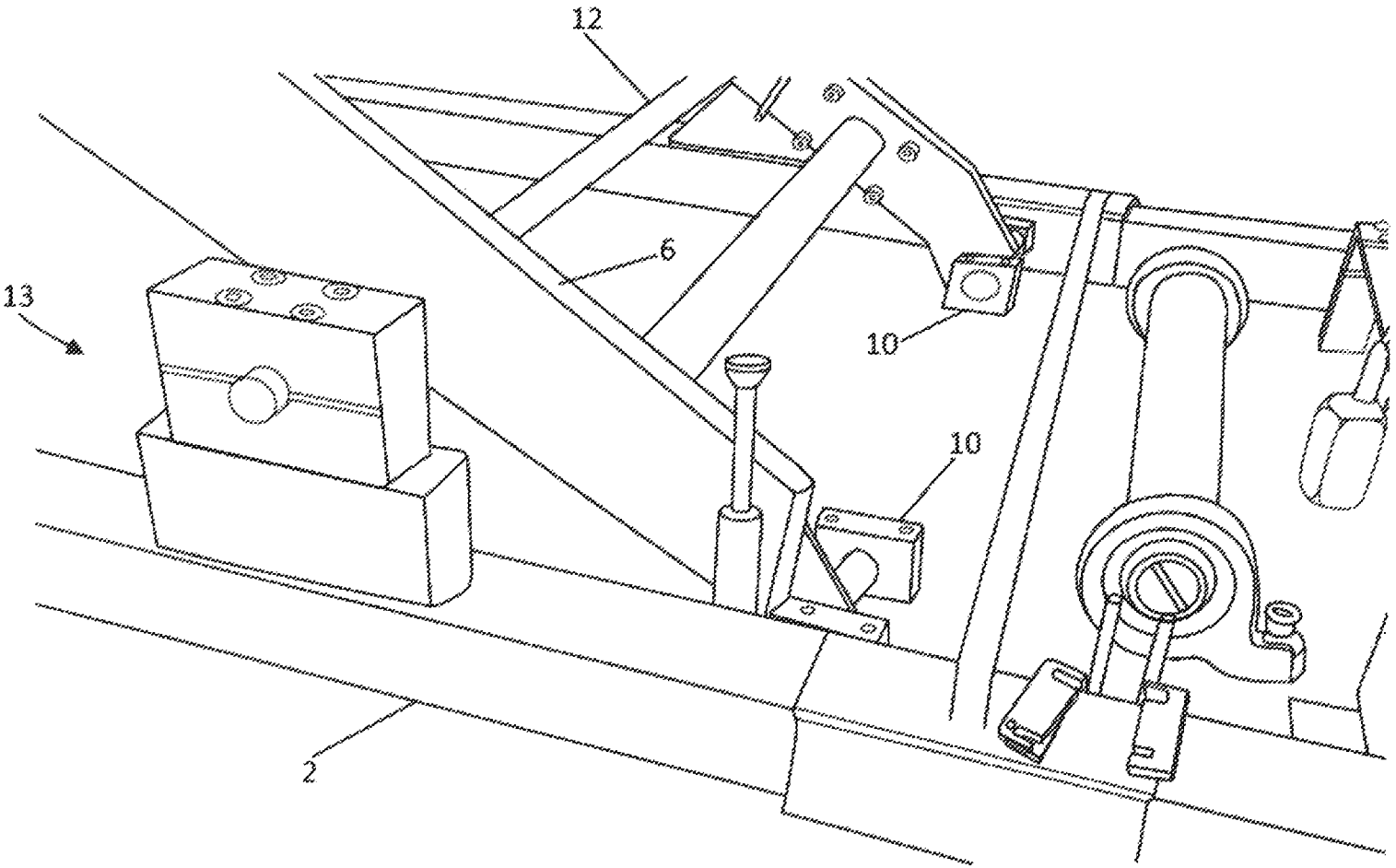
FIG. 2 is a perspective elevation of an exemplary inventive lift table system having a lift table and a fixing device attached thereto.

The exemplary inventive lift table depicted in FIG. 1 has a first base element 2 and a second base element 3 that are connected by a scissor 4. The scissor 4 has a first scissor part 6 and a second scissor part 7 that are connected by a pivot axis 5. In the example shown, each scissor part is essentially made of two scissor blades and transverse connecting elements for connecting the scissor blades.

For lifting and lowering the lift table, the exemplary inventive lift table has a drive 8 that acts on the scissor 4 via a tensioning means 9, the latter in the example shown being embodied as an arrangement of belt straps that may be wound on a shaft.

The first scissor part 6 is attached to the first base element 2 with fixed bearings 10. The second scissor part 3 is attached to the first base element 2 with floating bearings 11.

To make it possible to change the floating bearing, the first scissor part 6 may be pivotably fixed relative to the first base element 2 about a temporary pivot axis 12. For this, the exemplary inventive lift table system has a fixing device 13, which is a fixing device for the temporary pivot axis 12, which fixing device may be attached to the first base element 2. If the fixing device 13 is attached to the first base element 2, for instance if it is connected with the first base element 2 using a screw connection, the temporary pivot axis 12 can support the load that the first scissor part 6 normally introduces to the fixed bearings 10 and thus can unload the fixed bearings 10. A mechanical connection 14 that may be realized, for instance, by screws, and which in the exemplary lift table connects the fixed bearings 10 with the first base element 2, may now be disconnected without causing instability in the scissor lift table 1.

If, for instance, the lift table 1 is now lowered using the drive 8, i.e., the distance between the first base element 2 and the second base element 3 is caused due to the scissor parts 6 and 7 pivoting relative to one another about the scissor axis 5, the first scissor part 6 pivots relative to the first base element 2 about the temporary pivot axis 12.

Figure 3:
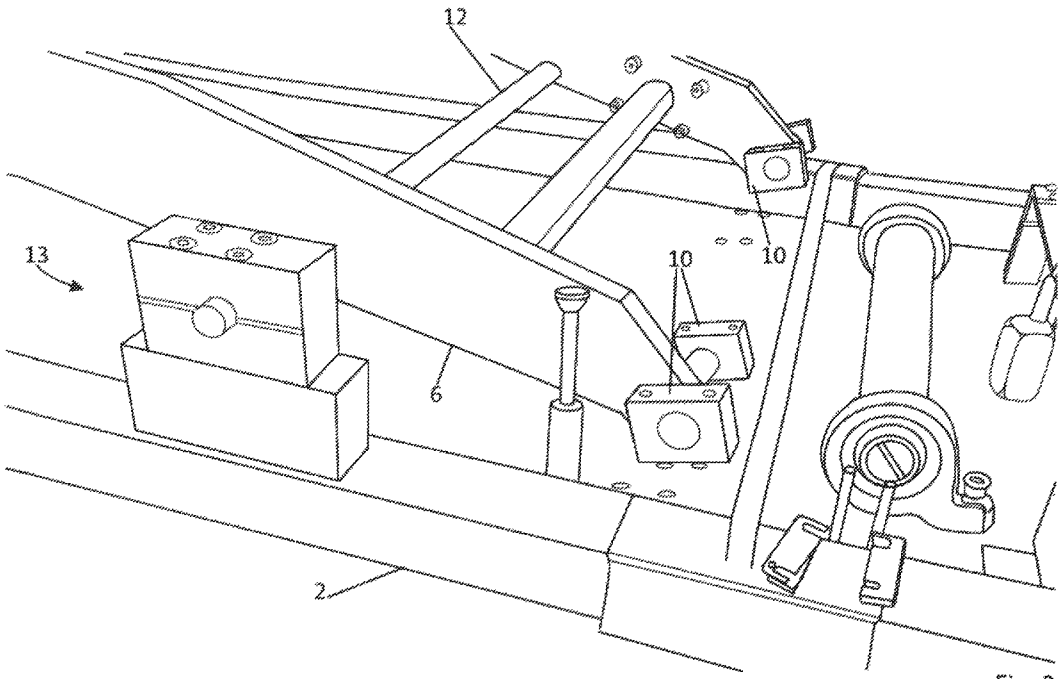
FIG. 3 depicts the lift table system illustrated in FIG. 2 having fixed bearings moved away from the base element.
Figure 4:
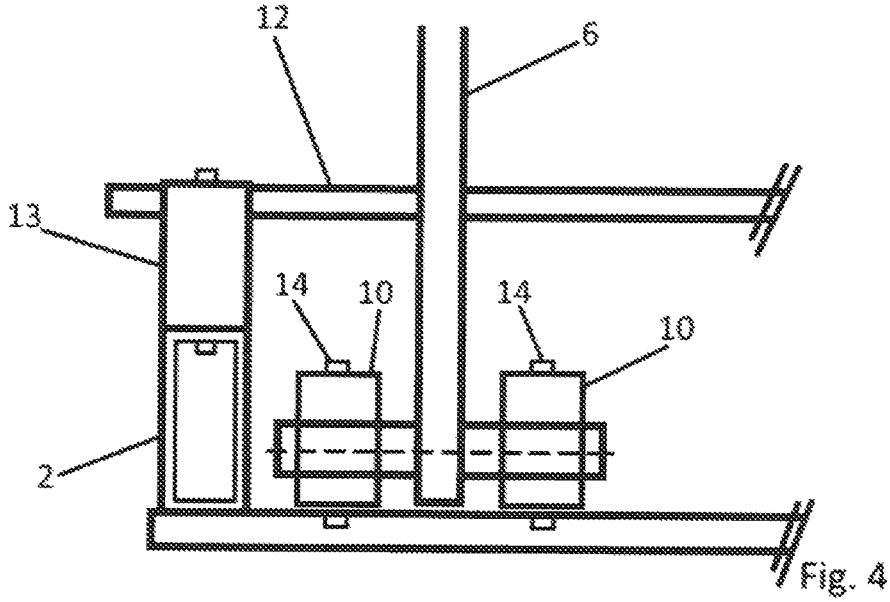
FIGS. 4 and 5 are each simplified sectional depictions of the scissor table system illustrated in FIGS. 2 and 3.
Figure 5:
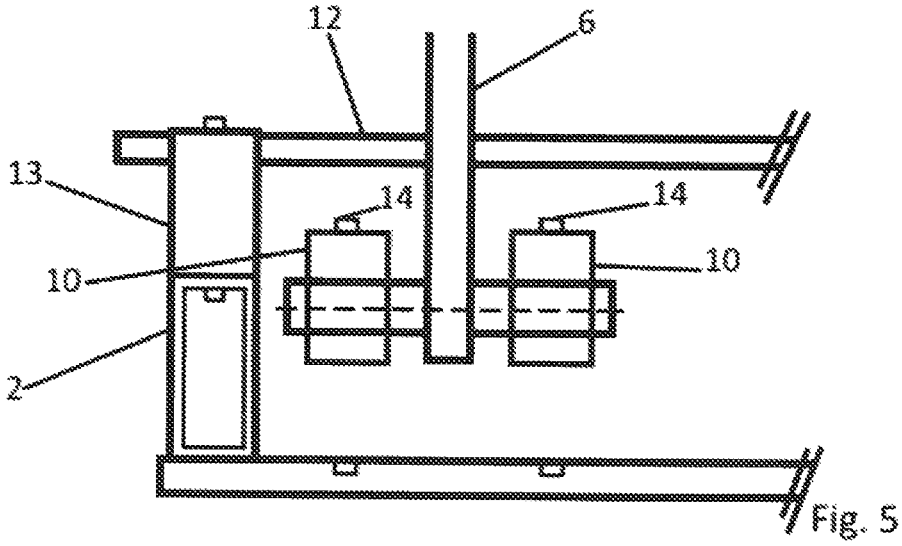

In the example illustrated, the temporary pivot axis 12 is advantageously arranged between the scissor axis 5 and the fixed bearing 10. Thus, when the lift table is lowered, the pivoting of the first scissor part 6 about the temporary pivot axis 12 causes the fixed bearing 10 to move away from the base element 2, as is schematically depicted in FIGS. 3 and 5. The fixed bearings are now unloaded and moved into an easily accessible position so that a simple exchange may take place.

Analogously, a fixing device 13 may also be attached to the second base element 3 in order, via another temporary pivot axis (not shown), to pivotably fix the second scissor part 7 relative to the second base element about the other temporary pivot axis 3.

Then, analogous to the example described in the foregoing, the fixed bearings, which connect the second scissor part 7 with the second base element 3, may be changed.

REFERENCE LIST

1—Scissor lift table
2—First base part
3—Second base part
4—Scissor
5—Scissor axis
6—First scissor part
7—Second scissor part
8—Drive
9—Tensioning means
10—Fixed bearing
11—Floating bearing
12—Temporary pivot axis
13—Fixing device
14—Mechanical connection

What is claimed is:

1. A scissor lift table (1), comprising a first base element (2) and a second base element (3) and a scissor (4), wherein the scissor (4) has a first scissor part (6) and a second scissor part (7), wherein the first scissor part (6) and the second scissor part (7) are pivotable relative to one another about a scissor axis (5), wherein the first base element (2) and the second base element (3) are connected by the scissor (4) such that a pivoting of the scissor parts (6, 7) relative to one another about the scissor axis (5) causes a change in the distance between the first base element (2) and the second base element (3), wherein the first scissor part (6) is pivotably borne on the first base element (2) using a fixed bearing (10) and the second scissor part (7) is displaceably and pivotably borne on the first base element (2) using a floating bearing (11), further comprising:

a temporary pivot axis (12) about which the first scissor part (6) is pivotably fixable relative to the first base element (2);

a fixing device (13) for pivotably fixing the temporary pivot axis (12) relative to the first base element (2); and a disconnectable mechanical connection (14) between the fixed bearing (10) and the first base element (2), wherein the position of the temporary pivot axis (12) is selected such that when the first scissor part (6) is fixed and the disconnectable mechanical connection (14) is disconnected, reducing the distance between the first base element (2) and the second base element (3) causes an increase in the distance between the first base element (2) and the fixed bearing (10).

2. The scissor lift table (1) according to claim 1, wherein the first base element (2) is located below the second base element (3).

3. The scissor lift table (1) according to claim 1, wherein the second scissor part (7) is pivotably borne on the second base element (3) using another fixed bearing and the first scissor part (6) is displaceably and pivotably borne on the second base element using another floating bearing, further comprising:

another temporary pivot axis about which the second scissor part (7) is pivotably fixed relative to the second base element (3);

another fixing device for pivotably fixing the another temporary pivot axis relative to the second base element (3); and another disconnectable mechanical connection between the other fixed bearing and the second base element (3), wherein the position of the another temporary pivot axis is selected such that when the second scissor part (7) is fixed and the another mechanical connection (14) is disconnected, reducing the distance between the first base element (2) and the second base element (3) causes an increase in the distance between the second base element (3) and the another fixed bearing.

4. The scissor lift table (1) according to claim 3, wherein the temporary pivot axis (12) is located between the fixed bearing (10) and the scissor axis (5), proximal to the first scissor part (6), and the another temporary pivot axis (12) is located between the another fixed bearing (10) and the scissor axis, proximal to the second scissor part (7).

5. The scissor lift table (1) according to claim 1, wherein the temporary pivot axis (12) is located between the fixed bearing (10) and the scissor axis (5), proximal to the first scissor part (6).

6. A scissor lift table system comprising a scissor lift table (1) and a fixing device (13) for temporarily fixing at least one of a first scissor part (6) and a second scissor part (7), wherein the scissor lift table (1) comprises a first base element (2) and a second base element (3) and a scissor (4), wherein the scissor (4) has a first scissor part (6) and a second scissor part (7), wherein the first scissor part (6) and the second scissor part (7) are pivotable relative to one another about a scissor axis (5), wherein the first base element (2) and the second base element (3) are connected by the scissor (4) such that a pivoting of the scissor parts (6, 7) relative to one another about the scissor axis (5) causes a change in the distance between the first base element (2) and the second base element (3), wherein the first scissor part (6) is pivotably borne on the first base element (2) using a fixed bearing (10) and the second scissor part (7) is displaceably and pivotably borne on the first base element (2) using a floating bearing (11), the scissor lift table ((1) further comprising:

a temporary pivot axis (12) about which the first scissor part (6) is pivotably fixable relative to the first base element (2);

a fixing device (13) for pivotably fixing the temporary pivot axis (12) relative to the first base element (2); and a disconnectable mechanical connection (14) between the fixed bearing (10) and the first base element (2), wherein the position of the temporary pivot axis (12) is selected such that when the first scissor part (6) is fixed and the disconnectable mechanical connection (14) is disconnected, reducing the distance between the first base element (2) and the second base element (3) causes an increase in the distance between the first base element (2) and the fixed bearing (10).

7. The scissor lift table system according to claim 6, wherein the fixing device (13) has an axis for connecting with at least one of the first scissor part (6) and the second scissor part (7).

8. The scissor lift table system according to claim 7, wherein the fixing device (13) has an axis support for connecting with at least one of the first base element (2) and the second base element (3).

9. The scissor lift table system according to claim 6, wherein the fixing device (13) has an axis support for connecting with at least one of the first base element (2) and the second base element (3).

10. The scissor lift table system according to claim 6, wherein the second scissor part (7) is pivotably borne on the second base element (3) using another fixed bearing and the first scissor part (6) is displaceably and pivotably borne on the second base element using another floating bearing, wherein the scissor lift table (1) further comprises:

another temporary pivot axis about which the second scissor part (7) is pivotably fixed relative to the second base element (3);

another fixing device for pivotably fixing the another temporary pivot axis relative to the second base element (3); and another disconnectable mechanical connection between the other fixed bearing and the second base element (3), wherein the position of the another temporary pivot axis is selected such that when the second scissor part (7) is fixed and the another mechanical connection (14) is disconnected, reducing the distance between the first base element (2) and the second base element (3) causes an increase in the distance between the second base element (3) and the another fixed bearing.

11. A method for changing a fixed bearing (10) of a scissor lift table (1), wherein the scissor lift table (1) comprises a first base element (2) and a second base element (3) and a scissor (4), wherein the scissor (4) has a first scissor part (6) and a second scissor part (7), wherein the first scissor part (6) and the second scissor part (7) are pivotable relative to one another about a scissor axis (5), wherein the first base element (2) and the second base element (3) are connected using the scissor (4) such that pivoting the scissor parts (6, 7) relative to one another about the scissor axis (5) causes a change in the distance between the first base element (2) and the second base element (3), wherein the first scissor part (6) is pivotably borne on the first base element (2) using a fixed bearing (10) and the second scissor part (7) is displaceably and pivotably borne on the first base element (2) using a floating bearing (11), comprising the steps of:

a) pivotably fixing the first scissor part (6) relative to the first base element (2) about a temporary pivot axis (12) fixed to a fixing device (13), wherein the position of the temporary pivot axis (12) is selected such that reducing the distance between the first base element (2) and second base element (3) may cause an increase in the distance between the first base element (2) and the fixed bearing (10);

b) disconnecting a mechanical connection (14) between the fixed bearing (10) and the first base element (2); and c) reducing the distance between the first base element (2) and the second base element (3).

12. The method according to claim 11, wherein the distance between the first base element (2) and the second base element (3) is reduced using a drive (9) for lifting and/or lowering the scissor lift table (1).

* * * * *